United States Patent [19]

Bako

[11] 4,355,524

[45] Oct. 26, 1982

[54] COMBINATION LOCKS

[75] Inventor: Lazlo Bako, Woodcliff Lake, N.J.

[73] Assignee: Kidde, Inc. (Presto Lock Company Division), Garfield, N.J.

[21] Appl. No.: 167,919

[22] Filed: Jul. 11, 1980

[51] Int. Cl.[3] ..... E05B 37/02

[52] U.S. Cl. ..... 70/312; 70/318

[58] Field of Search ..... 70/20-30, 70/67-76, 312, 315-318

[56] References Cited

U.S. PATENT DOCUMENTS

| | | | |
|---|---|---|---|
| 2,163,852 | 6/1939 | Pond | 70/21 |
| 3,555,860 | 1/1971 | Atkinson | 70/312 |
| 3,720,082 | 3/1973 | Feinberg et al. | 70/25 |
| 3,766,758 | 10/1973 | Heine et al. | 70/25 |
| 3,800,571 | 4/1974 | Heine | 70/71 |
| 3,983,724 | 10/1976 | Foote | 70/25 |
| 4,048,821 | 9/1977 | Bako et al. | 70/25 |
| 4,123,923 | 11/1978 | Bako | 70/74 |

*Primary Examiner*—Robert L. Wolfe

*Attorney, Agent, or Firm*—Shapiro and Shapiro

[57] ABSTRACT

A dial and sleeve type combination lock is provided with a shift member to move the sleeves out of coupling engagement with the dials for changing the combination of the lock. The shift member includes a manual actuator extending through an opening in the face plate of the lock which opening extends transversely to the axis of the sleeves and movement of the actuator in the opening in the transverse direction effects axial movement of the sleeves by means of an oblique camming surface on the shift member.

9 Claims, 8 Drawing Figures

COMBINATION LOCKS

BACKGROUND OF THE INVENTION

The use of combination locks, which dispense with the need for a separate key, has in recent years become increasingly popular on articles such as luggage articles, camera, and instrument cases, and the like.

Such locks commonly employ a mechanism whereby the combination of the lock can be changed to one of the user's own choice, by manipulation of a combination-changing device. In the case of locks, for example of the rotary dial and sleeve type, where for combination changing it is necessary to move the sleeves or other combination elements axially out of coupling engagement with the dials or the like, this is normally accomplished by a shift member having a manual actuator. Generally, the actuator has only been accessible from the back of the lock, i.e., from the interior of the article to which the lock is applied and, in certain instances, this has proved to be cumbersome in operation. Further, the actuator has generally needed to be moved in the axial direction of movement of the sleeves relative to the dials in order to uncouple the dials from the sleeves. (See, for example, U.S Pat. No. 3,800,571 to Heine, issued Apr. 2, 1974, and commonly assigned herewith.)

It is an object of the present invention to provide a novel form of shift mechanism for a combination lock of the type in which a plurality of combination elements, such as sleeves, are moved axially in unison in order to effect a combination change.

Another object of the invention is to provide a combination lock of the type having a plurality of combination elements adapted to be moved axially in unison in order to effect a combination change, wherein an actuator for shifting the elements is moved in a direction other than the axial direction of movement of the elements.

A further object of the invention is to provide a combination lock suitable for use on articles of luggage and the like, wherein a shift mechanism for changing the combination of the lock is readily accessible from the exterior of an article to which the lock is applied.

It has previously been proposed in connection with combination padlocks, for example, which employ rotary dials and sleeves, to move the sleeves out of coupling engagement with the dials by utilizing the longer leg of the padlock shackle to provide axial movement of the sleeves by movement of the shackle in a direction other than the direction of axial movement of the sleeves, see, for example, U.S. Pat. No. 3,766,758 to Heine, et al, issued Oct. 23, 1973 and U.S. Pat. No. 4,048,821 to Bako, et al, issued Sept. 20, 1977. The present invention, however, is primarily concerned with providing alternative and simplified means for effecting axial movement of the combination elements, for combination changing purposes, by means of an actuator which is operated other than in the direction of movement of the elements.

SUMMARY OF THE INVENTION

In accordance with the invention, at least in a preferred embodiment thereof, axial movement of the combination elements of a combination lock in order to effect a change in combination, is provided by linearly moving an actuator in a direction transversely to the axis of the elements, such movement of the actuator being converted through camming means into axial movement of the combination elements.

In a preferred form, the combination elements, such as combination sleeves, in a sleeve and dial type lock, are carried on a shaft in a lock casing and the actuator is formed as a portion of a shift member mounted on one end of the shaft. The actuator extends through an opening, preferably in the face plate of the lock, which opening extends generally transversely to the axis of the shaft and the actuator includes an oblique cam surface engaging a collar fixed on the shaft in abutting engagement with the combination elements. When the lock is on combination, the actuator can be moved in the transverse opening whereby the cam surface affects axial movement of the shaft and sleeves by reaction of the shift member with an interior surface of the casing.

The invention may be applied to locks having different forms of locking members, and the shift member can be designed to hold the locking member in an unlocked position during a combination changing operation, to avoid loss of the combination.

DESCRIPTION OF PREFERRED EMBODIMENT

Figure 1:
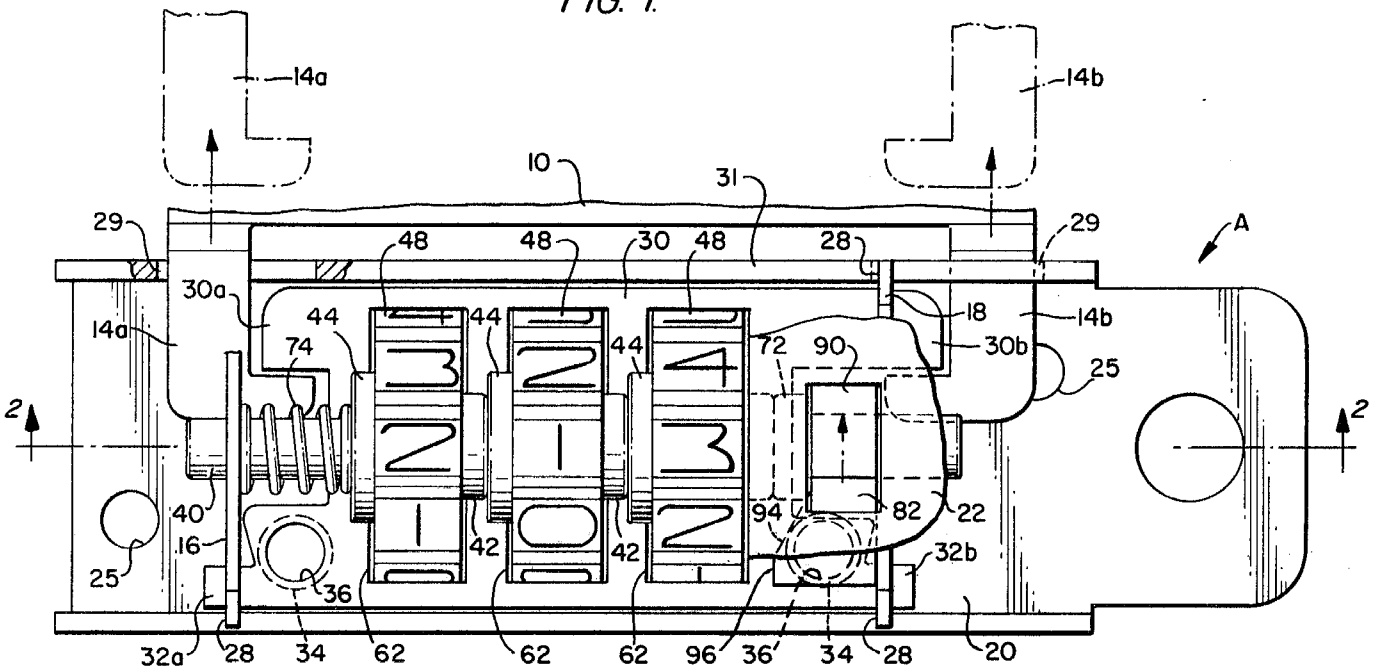
FIG. 1 is a plan view of a combination lock in accordance with the invention, with parts of the lock being cut away.

The illustrated combination lock is of a generally known type employing a locking member in the form of a pivotal bolt adapted to engage a hasp, the bolt being movable between locking and unlocked positions under the control of a plurality of combination dials and sleeves. The arrangement is such that when the dials and sleeves are on-combination, the bolt automatically assumes its unlocked position, in which the hasp can be inserted or withdrawn from the lock, and when the dials and sleeves are off-combination, the bolt automatically assumes its locking position in which it prevents an inserted hasp from being withdrawn from the lock.

Locks having the above type of locking and unlocking action are known, see for example U.S. Pat. No. 3,800,571 referred to above. It is to be understood that the present invention is not concerned with the locking and unlocking action per se, and this form of lock is merely used for illustrative purposes as one type of lock to which the present invention may be applied. Thus, the present invention is concerned with a shift mechanism for moving combination elements, such as sleeves, axially out of coupling engagement with associated lock components in order to effect a combination change. The invention can be applied to locks having a locking and unlocking action different to the pivotal bolt type locking and unlocking action herein referred to.

Referring now specifically to the drawings, the illustrated lock generally indicated by reference A, may be attached to a valance B of one section of say a luggage article (see FIG. 3) with the other section C of the article carrying a hasp 10 having projecting tongues 14*a*, 14*b* (FIG. 1) adapted to enter openings in the lock and engage a pivotal bolt 30 to releasably secure the sections of the luggage or like article together.

Lock A has a casing which may for example be formed by a channel shaped base member 20, a face plate 22, a side wall member 24 and 26 and end brackets 16 and 18. The design and assembly of the casing components is not critical and can follow established practice for locks of this type. As illustrated, base member 20, has openings 25 for attaching the lock, as by screws, rivets, or the like, to valance B and side wall member 24 has openings 27 aligned with similar openings 29 in upright wall 31 of the base member, for admission of the hasp tongues 14*a* and 14*b*.

Figure 8:
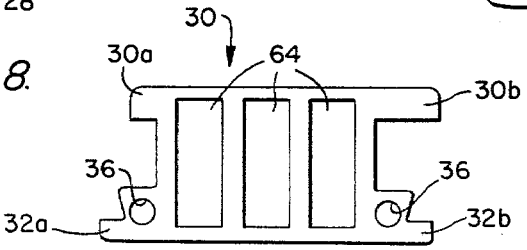
FIG. 8 is a plan view of a pivotal bolt.

Brackets 16 and 18 which define opposite end walls of the casing, respectively, may for example be located in recesses 28 in the opposite upright walls of base member 20. The pivotal bolt 30 (FIG. 8) is mounted in brackets 16 and 18 by ears 32*a*, 32*b* of the bolt which fit in corresponding openings in the brackets, and coil springs 34 act between base member 20 and bosses 36 on the undersurface of the bolt, to urge the bolt upwardly into the position shown in FIG. 2 and shown in solid line in FIGS. 3 and 4. In this, the unlocked position of the bolt, the hasp tongues 14*a* and 14*b* are free to enter and to be removed from the lock through openings 27 and 29. When bolt 30 is lowered, however, to the locking position, against springs 34, by means to be described, and as shown in phantom in FIGS. 3 and 4, bolt tongues 30*a* and 30*b* align vertically with the hasp tongues 14*a* and 14*b* to prevent disengagement with the hasp. Downward movement of bolt 30 is limited by a stop 39 on base member 20.

Brackets 16 and 18 also serve to mount a shaft 40 carrying a series of combination elements in the form of sleeves 42, arranged end-to-end on shaft 40, and each having an encircling combination dial 48. The dials and sleeves are of conventional type isofar as the dials have internal teeth 56 or the like which mesh with complementary teeth 58 or the like on the sleeves, whereby the dials and sleeves are coupled for mutual rotation on shaft 40. The dials also have a conventional series of circumferential combination indicia on their outer surfaces, with locating detents 60 therebetween, and a portion of the periphery of each dial protrudes from casing 10 through respective slots 62, in face plate 22. Similarly, the dials protrude through aligned slots 64 in bolt 30. A conventional dial spring 68 on base member 20 has limbs 70 engaging in the detents 60 of the respective dials.

Figure 2:
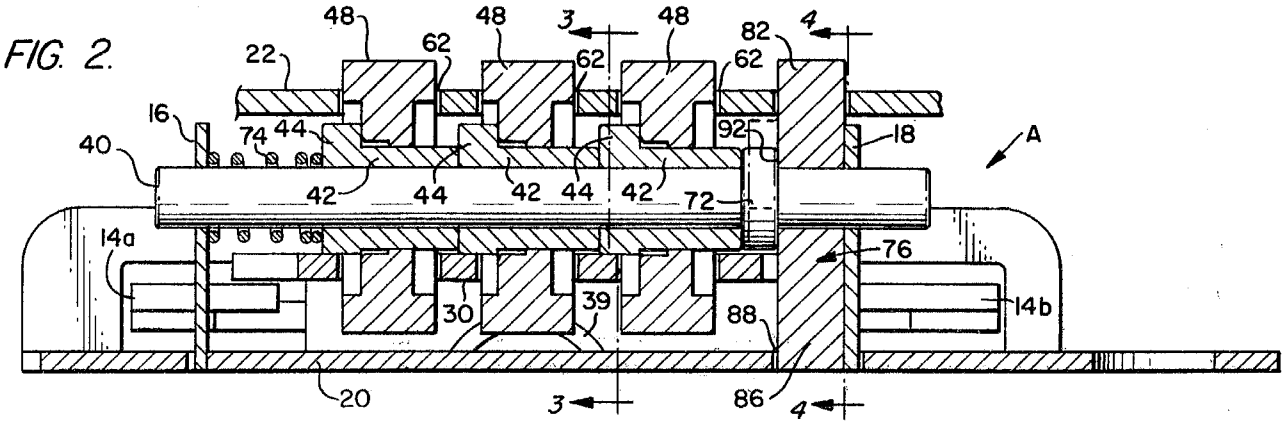
FIG. 2 is a longitudinal section along line 2—2 of FIG. 1.

Shaft 40 further has a fixed or integrally formed collar 72 adjacent the right end sleeve 42, and a coil spring 74 surrounding the shaft and acting between bracket 16 and the left end sleeve. Between collar 72 and bracket 18, the shaft 40 is embraced by a pivotal shift member 76, the shift member having a laterally extended opening 78 through which the shaft extends. Spring 74 urges the assembly of sleeves, shaft and shift member to the right as seen in FIG. 2, and holds the sleeves in coupling engagement with the respective dials.

Figure 3:
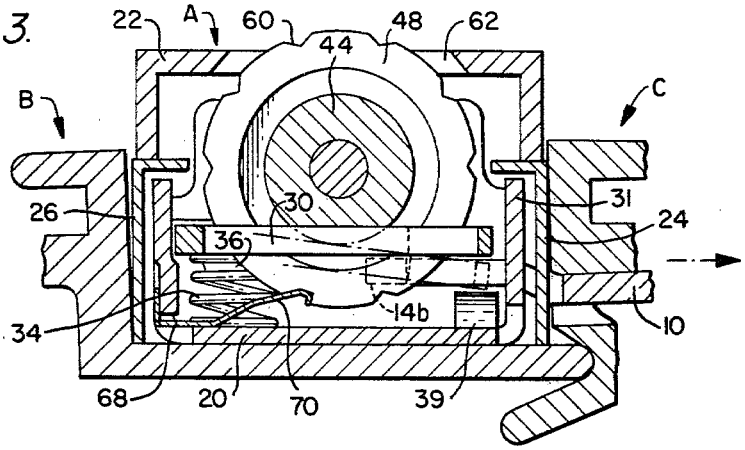
FIG. 3 is a cross section along line 3—3 of FIG. 2.

Sleeves 42 have enlarged bosses 44 at the left-hand ends thereof defining circumferential cam surfaces. These cam surfaces have part-circular portions 46 and flattened portions 50, and the cam surfaces act on the upper surface of bolt 30 to control the position of the bolt. Thus, when all the sleeves are aligned by suitable manipulation of the dials, such that the flattened portions of the respective sleeves all engage the bolt (i.e., the on-combination condition), as shown in FIGS. 2 and 3, the bolt is free to rise to the unlocked position. If at least one of the sleeves is rotated from this position, the part-circular portion of the sleeve's cam surface cams the bolt down to the locked position. Thus, for the bolt to be unlocked, all the sleeves must have their flat portions in aligned engagement with the bolt and for the bolt to be locked, any one, or more of the sleeves, must be rotated so that the part-circular cam portion engages the bolt. This form of locking and unlocking action, as indicated, is known and will be readily apparent to those skilled in the art.

To enable the combination of the lock to be changed, it is necessary to move the sleeves 42 axially out of coupling engagement with the respective dials, so that at least one of the dials can be rotated independently of its respective sleeve. This is accomplished by shift member 76 when the lock is on combination, as will now be described.

Figure 6:
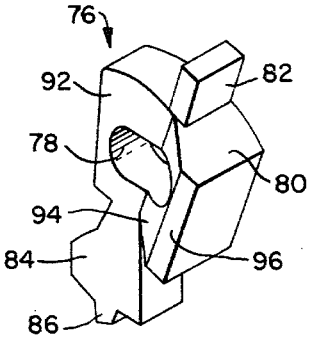
FIG. 6 is a perspective view of a shift member used in the lock.

Shift member 76, as shown particularly in FIG. 6, includes a body portion 80 an upwardly projecting manual actuator portion 82, a depending lobe portion 84 and a tab 86. Tab 86 fits in a complementary opening 88 in base member 20 providing a pivotal mounting for the shift member about a pivot axis substantially parallel to the axis of shaft 40 and thereby allowing pivotal movement of the shift member transversely to the axis of shaft 40. Manual actuator portion 82 projects from the lock casing through a transverse opening 90 in face plate 22. The left-hand surface of body portion 80 of the shift member, which surface faces the sleeves 42 and abuts shaft collar 72, has three portions, namely a subsequent transversely extending portion 92, an obliquely extending camming portion 94, and a further transverse portion 96.

Figure 4:
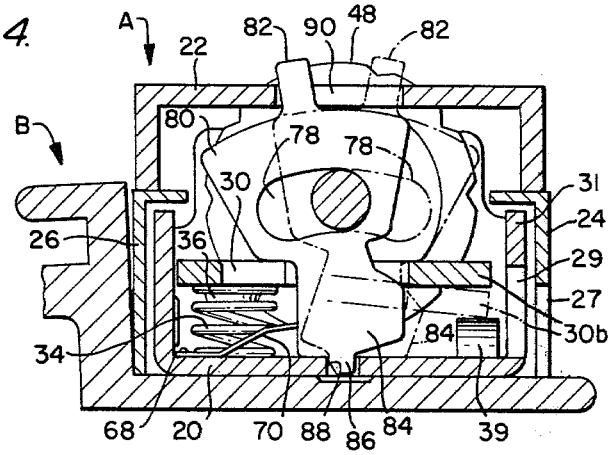
FIG. 4 is a cross section along line 4—4 of FIG. 2.
Figure 5:
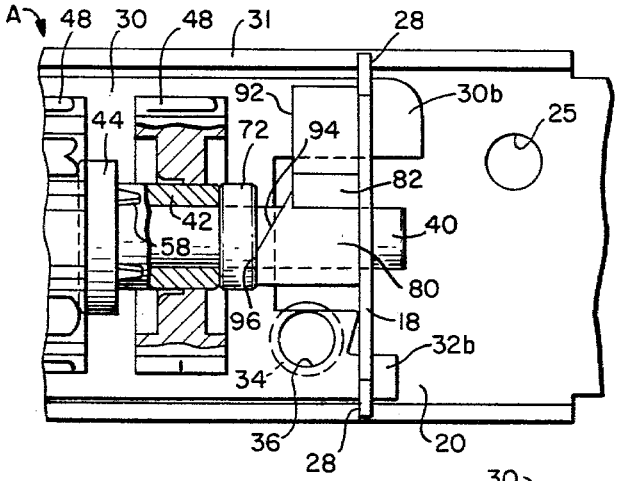
FIG. 5 is a view similar to FIG. 2 but showing parts of the lock in a combination changing position.
Figure 7:
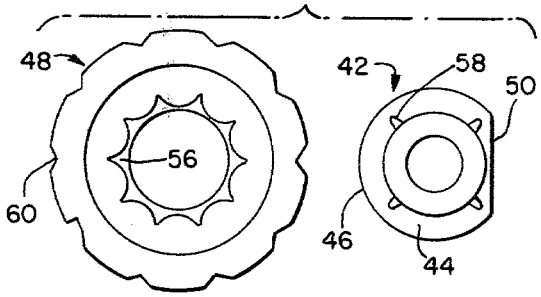
FIG. 7 is a composite end view of a combination dial and a combination sleeve.

In the normal rest position of shift member 76, actuator portion 82 is in the position in opening 90 shown in full line in FIGS. 1 and 4. When the lock is off combination, the bolt being in its locked, lowered position, shown in phantom in FIG. 4, tongue 30*b* of the bolt is in a blocking position with respect to lobe portion 84 of the shift member and actuator portion 82 of the shift member cannot therefore be effectively moved transversely to the right in opening 90. In this condition of the lock, surface portion 92 of the shift member engages shaft collar 72. When the lock is on combination, however, with the bolt in its raised, unlocked position, tongue 30*b* clears lobe portion 84 and frees actuator portion 82 for movement in opening 90. In this condition, actuator portion 82 can be moved in opening 90 from left to right as shown in FIG. 4. This movement causes the oblique camming surface portion 94 of the shift member to move the shaft 40 and sleeves 42 to the left as shown in FIG. 2 by a camming action, the shift member reacting with the inner surface of bracket 18. Accordingly, this motion is effective for moving the sleeves out of coupling engagement with the respective dials, axial movement of the sleeves being effected by transverse linear movement of actuator portion 82, without any axial movement of the shift member. In the terminal position of the actuator portion 82, as shown in FIG. 5 and in phantom in FIG. 4, transverse surface portion 96 of the shift member is in engagement with shaft collar 72. Thus, the shift member holds the shaft and sleeves in the uncoupled condition so that the actuator portion can be released for combination changing purposes.

Further, in the terminal position of actuator portion 82, lobe portion 84 engages under the bolt tongue 30*b* and prevents the bolt from being moved downwardly into its locked position. This prevents sleeves 42 from rotating and thereby losing the combination. After the combination has been changed, actuator portion 82 can be returned to its rest position, allowing spring 74 to return the sleeves axially into coupling engagement with the respective dials, thereby setting the new combination and returning the lock components to the position shown in FIG. 2.

It will be seen from the foregoing that the invention provides a convenient form of shift mechanism for use with combination locks suitable for application to articles of luggage and the like, which shift mechanism can be operated from the top of the lock casing, i.e., from externally of the article to which the lock is applied. Further, the shift mechanism is operated by moving a manual actuator other than in the direction of movement of the combination elements that are moved.

While only a single preferred embodiment of the invention has been described herein in detail, it is to be understood that the invention is not limited thereby and modifications can be made within the scope of the attached claims.

I claim:

1. A combination lock including a plurality of combination elements disposed on a common axis in a casing for axial movement in unison out of coupling engagement with cooperating combination components in order to change the combination of the lock, a shift member for moving said elements axially, means mounting said shift member in said casing for movement substantially transversely to said common axis, said shift member including an actuator portion extending through an opening in said casing and means providing a camming action between said shift member and said elements for causing said shift member to move said elements axially responsive to transverse movement of said shift member when operated by said actuator portion, wherein said shift member is located between said combination elements and a reaction surface of said casing extending transversely to said axis and wherein said means providing a camming action includes a camming portion on a surface of said shift member facing the combination elements, the camming portion extending obliquely to said axis whereby movement of said actuator portion in said opening causes said camming surface to move said elements axially by reaction of said shift member with said reaction surface without axial movement of the shift member.

2. A lock as defined in claim 1, wherein said means mounting said shift member in said casing includes means mounting said shift member for pivotal movement about a pivot axis substantially parallel to said common axis.

3. A lock as defined in claim 2, wherein said combination elements comprise sleeves mounted axially in abutting relation on a shaft defining said axis and said cooperating combination components comprise dials encircling said sleeves, said dials having peripheral portions extending through slots in a face plate of the lock, said opening being formed in said face plate.

4. A lock as defined in claim 3, wherein said shift member has a transversely extending opening embracing said shaft adjacent a terminal one of said sleeves, said opening allowing pivotal movement of said shift member transversely to the axis of said shaft.

5. A lock as defined in claim 3, including a collar on said shaft between a terminal one of said sleeves and said shift member, said shift member having an opening embracing said shaft adjacent said collar, and said shift member engaging said collar to move said shaft and said sleeves axially responsive to movement of said actuator portion in said opening.

6. A lock as defined in claim 1, including a locking member in said casing controlled by said combination elements for movement between locking and unlocked positions, said shift member including a lobe portion adapted to engage said locking member when said locking member is in locking position for inhibiting movement of said actuator portion in said opening to effect a combination change, said lobe portion clearing said locking member when said locking member is in unlocked position.

7. A lock as defined in claim 6, wherein said actuator has a terminal position in said opening for holding said combination elements in combination changing position, said lobe portion engaging said locking member in said terminal position of the actuator portion to retain said locking member in unlocked position.

8. A lock as defined in claim 6, wherein said locking member is a pivotal bolt and said sleeves each include a flange having a cam surface engaging said bolt for controlling movement of said bolt between said locking and unlocked positions dependent upon the alignment of the respective cam surfaces.

9. A lock as defined in claim 1, wherein said surface of said shift member facing said combination elements has a transverse portion adjacent said camming portion for holding the combination elements out of coupling engagement with the cooperating components.

* * * * *